United States Patent [19]

Uchida et al.

[11] Patent Number: 4,941,021

[45] Date of Patent: Jul. 10, 1990

[54] IMAGE FORMING APPARATUS WITH RECORDING MATERIAL LOOP FORMING AND CONTROL MEANS

[75] Inventors: Takashi Uchida, Kawasaki; Osamu Hoshino; Yasushi Murayama, both of Tokyo, all of Japan

[73] Assignee: Canon Kabushiki Kaisha, Tokyo, Japan

[21] Appl. No.: 318,464

[22] Filed: Feb. 28, 1989

Related U.S. Application Data

[63] Continuation of Ser. No. 1,176, Jan. 7, 1987, now abandoned.

[30] Foreign Application Priority Data

Jan. 10, 1986 [JP] Japan ..... 61-3185
Jan. 10, 1986 [JP] Japan ..... 61-3186

[51] Int. Cl.[5] ..... G03G 15/20

[52] U.S. Cl. ..... 355/285; 271/265; 219/216; 355/309; 355/326

[58] Field of Search ..... 355/14 FU, 3 FU, 14 SH, 355/14 R, 35 H, 4, 282, 285, 289, 290, 295, 309, 326, 327; 271/227, 242, 265; 219/216; 432/60

[56] References Cited

U.S. PATENT DOCUMENTS 3,937,919 2/1976 Clerx et al. ..... 219/216

*Primary Examiner*—Fred L. Braun
*Attorney, Agent, or Firm*—Fitzpatrick, Cella, Harper & Scinto

[57] ABSTRACT

An image forming apparatus in which a recording material having an unfixed image formed thereon by an image forming device is conveyed to a fixing device having a pair of rotatable members by a conveyor and the recording material is nipped and conveyed by the pair of rotatable members so that the unfixed image is fixed on the recording material. The pair of rotatable members is selectively rotatable at a first peripheral speed lower than the speed at which the conveyor conveys the recording material and a second peripheral speed higher than the first peripheral speed. The pair of rotatable members are rotated at the first peripheral speed to convey the recording material and form a loop of recording material rearwardly of the pair of rotatable members with respect to the direction of conveyance of the recording material, whereafter the peripheral speed of the pair of rotatable members is changed over from the first peripheral speed to the second peripheral speed to suppress the growth of the loop of the recording material.

13 Claims, 8 Drawing Sheets

IMAGE FORMING APPARATUS WITH RECORDING MATERIAL LOOP FORMING AND CONTROL MEANS

This application is a continuation of application Ser. No. 001,176, filed Jan. 7, 1987, now abandoned.

BACKGROUND OF THE INVENTION

1. Field of the Invention

This invention relates to an image forming apparatus such as a copying machine, a facsimile apparatus or a printer utilizing the electrophotographic system, the electrostatic recording system, the heat transfer system or the like, to form images on recording materials and thereby obtain hard copies.

2. Related Background Art

An image forming apparatus such as an electrophotographic apparatus usually has, as the conveyance path of a recording material, a series of conveyance paths for feeding, transferring, fixing and discharging of the recording material having an image formed thereon out of the apparatus. In this case, any difference between the conveyance speeds of elements constituting the conveyance path has sometimes reduced the quality of the image formed. For example, in an electrophotographic apparatus as shown in FIG. 5 of the accompanying drawings, a toner image formed on a photosensitive drum 102 as an image bearing member is transferred to a recording material fed from a cassette 106, at a transfer station 104, by the action of a charger 103. By the corona discharge produced from the charger 103 during the transfer, coupled with the movement of the photosensitive drum 102, the conveyance force by the photosensitive drum for the recording material is created. This conveyance force results from electrostatic attraction and is very small as compared with the conveyance force provided in an apparatus of a construction in which a plurality of rollers such as a pair of conveying rollers 110 and a pair of fixing rollers 101 are urged against each other and a recording material is conveyed while being nipped between those rollers. In such case, with regard to the pair of conveying rollers 110, the drive force of the pair of conveying rollers 110 is released by the use, for example, of a clutch or the like at a point of time whereat the leading edge of the recording material arrives at the transfer station 104, whereby the influence thereof can be eliminated. However, the pair of fixing rollers 101 are generally such that a pair of rollers are opposed and urged against each other and a recording material is conveyed while being nipped between the pair of rollers to thereby accomplish the fixation of an unfixed toner image and therefore, the conveyance force of the pair of fixing rollers 101 is usually very great as compared with the conveyance force of the photosensitive drum 102. Thus, where the same recording material is caught by both the transfer station 104 and the pair of fixing rollers 101, that is, where transfer is still effected in the trailing end portion of the recording material and the peripheral speed of the pair of fixing rollers 101 is higher than the peripheral speed of the photosensitive drum 102 when fixation is being effected on the recording material as the latter is nipped and conveyed between the pair of fixing rollers 101, the recording material is pulled by the pair of fixing rollers 101 and slips in the transfer station 104 and thus, image transfer misregistration occurs on the recording material.

FIG. 6 of the accompanying drawings shows a full color image forming apparatus using a plurality of image bearing members. In this apparatus, a recording material fed from a cassette 106 is electrostatically attracted to a conveyor belt 105 and passes photosensitive drums 120, 130 and 140 in succession, whereby cyan, magenta and yellow toner images are successively transferred from the respective drums onto the recording material to form an unfixed full color image thereon, whereafter the unfixed image is fixed by a pair of fixing rollers 101 and the recording material having a completed image output thereon is discharged out of the apparatus. Also, in this apparatus, if the peripheral speed of the pair of fixing rollers 101 becomes higher than the speed of the conveyor belt 105 during the image transfer at the transfer station 150 of the photosensitive drum 140 and the recording material is pulled by the pair of fixing rollers 101, the attraction of the recording material to the conveyor belt 105 will be weakened and the recording material will slip in this portion. Therefore, transfer misregistration will occur to the image transferred from the photosensitive drum 140 onto the recording material, and this has led to color misregistration on the images which means clear degradation of the quality of image.

In the above-described examples of the prior art, when the peripheral speed of the pair of fixing rollers 101 is higher than the feeding speed of the recording material at the transfer station 104 of the photosensitive drum 102 or the feeding speed of the recording material at the transfer station 150 of the photosensitive drum 140 and moreover the recording material lies between the pair of fixing rollers 101 and the transfer station 104 or 150, the recording material is pulled by the pair of fixing rollers 101 and slips at the transfer station 104 or 150, whereby transfer misregistration occurs on the recording material and causes the quality of image to be degraded.

As a means for solving this problem, there is the measure of making the distance between the transfer station 104 or 150 and the pair of fixing rollers 101 greater than the length of the recording material used with respect to the direction of conveyance. According to such measure, the distance between the transfer station 104 or 150 and the pair of fixing rollers 101 is made longer than necessary and undesirably, this leads to an increased dead space occupied by the entire apparatus. Also, the direction of conveyance of the recording material is often the widthwise direction of the apparatus and accordingly, making said distance long has led to a problem that the apparatus becomes bulky and the degree of freedom of the space in which the apparatus is installed is remarkably decreased.

Another means for solution is disclosed in Japanese Patent Application No. 186671/1985 filed by the same assignee. This means comprises stopping the pair of fixing rollers when the leading edge of the recording material enters the nip between the pair of fixing rollers, forming a loop in the recording material, thereafter rotating the pair of fixing rollers and thereby absorbing the difference between the speed of rotation of the pair of fixing rollers and the feeding speed of the recording material at the transfer station. However, according to this method, the pair of fixing rollers are stopped and this requires a clutch, for example, and the mechanical rising and falling times of this clutch affects the interpaper spacing, and this provides a hindrance when a number of recording materials are conveyed continuously. Also, when a recording material enters the nip between the fixing rollers stopped, the resulting shock disturbs the unfixed toner image on the recording material and degrades the quality of the image and moreover, in the case of a full color image, said shock has resulted in the problem of color misregistration. Further, where the bus line of the photosensitive drum in the transfer station and the bus lines of the fixing rollers are not parallel to each other, there has also arisen a problem that the recording material is distorted to disturb the image thereon.

SUMMARY OF THE INVENTION

The present invention has been made in view of the above-described background art and a primary object thereof is to provide an image forming apparatus which can obtain accurate and clear-cut images.

Another object of the present invention is to provide an image forming apparatus which can ensure appropriate inter-paper spacing even during continuous feeding of paper sheets.

Still another object of the present invention is to provide an image forming apparatus which is compact.

Yet still another object of the present invention is to provide an image forming apparatus which can obtain color images free of color misregistration.

Other objects and features of the present invention will become apparent from the following detailed description taken in conjunction with the accompanying drawings.

DESCRIPTION OF THE PREFERRED EMBODIMENTS

Figure 1:
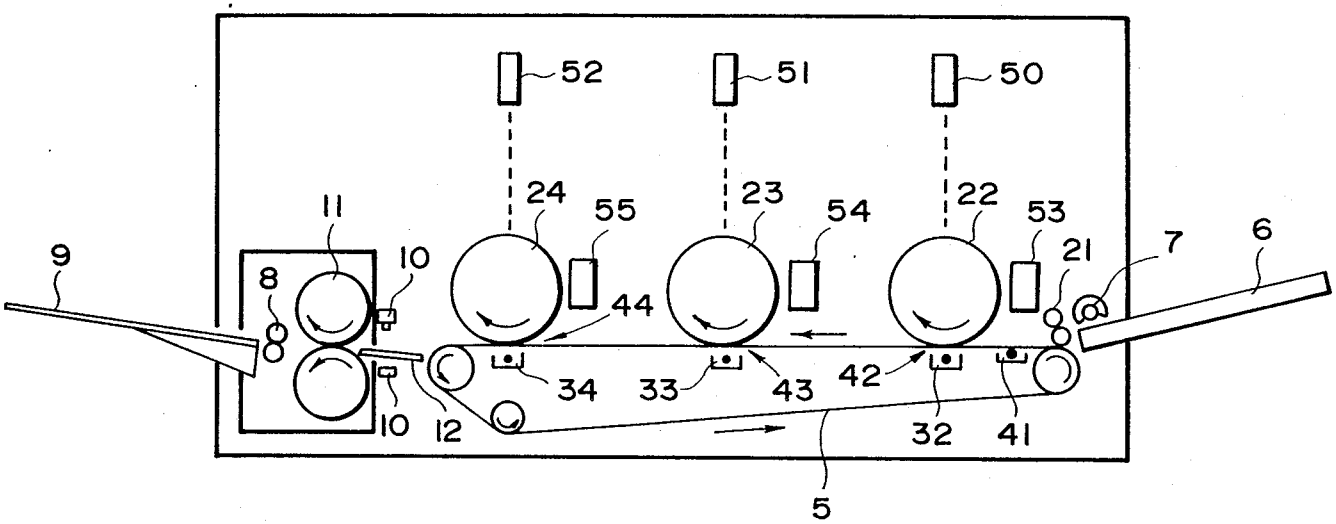
FIG. 1 is a schematic view showing a full color image forming apparatus to which the present invention is applied.

Some embodiments of the present invention will hereinafter be described with reference to the drawings. FIG. 1 shows a full color image forming apparatus as an image forming apparatus to which the present invention is applied. A recording material as an image carrier is fed from a cassette 6 to a pair of register rollers 21 by a pick-up roller 7. The recording material fed to the pair of register rollers 21 is further fed to a conveyor belt 5 with the timing of its feeding being measured by the pair of register rollers 21, and is electrostatically adsorbed to the conveyor belt 5 by an adsorbing charger 41. The recording material thus adsorbed passes through transfer stations 42, 43 and 44 comprising photosensitive drums 22, 23 and 24 as image bearing members and chargers 32, 33 and 34, whereby for example, unfixed magenta, cyan and yellow images are successively transferred to the recording material. Latent images are formed on the photosensitive drums 22, 23 and 24 by latent image forming means 50, 51 and 52, and magenta, cyan and yellow developers are supplied to these latent images from developing means 53, 54 and 55, respectively, whereby magenta, cyan and yellow developed images are pre-formed on the photosensitive drums 22, 23 and 24, respectively. The timing of the formation of these images is such that the leading edge of the image on each photosensitive drum is coincident with the leading edge of the recording material when the recording material arrives at each transfer station 42, 43 and 44. The method of forming the latent images may be a method whereby the photosensitive drums precharged by chargers are exposed to optical images color-resolved correspondingly to the image of an original and latent images corresponding to the respective color components are formed on the respective photosensitive drums, or a method whereby lights such as laser beams are applied to pre-charged photosensitive drums in accordance with image signals color-resolved correspondingly to image information and latent images corresponding to the respective color components are formed on the respective photosensitive drums.

On the other hand, the recording material to which the unfixed images have been transferred from the respective photosensitive drums is conveyed to a pair of fixing rollers 11 and passes through the nip between the pair of fixing rollers 11, whereby the unfixed images on the recording material are fixed. After the fixation, the recording material is discharged onto a tray 9 by paper discharge rollers 8 and thus, an image output in full color is obtained. In the present embodiment, a heating-fixing system using heat and pressure is adopted as the fixing system but alternatively, a pressure fixing system using only pressure may be adopted.

In FIG. 1, reference numeral 10 designates a sensor as detecting means for detecting the leading edge of the recording material. The sensor 10 may comprise, for example, a light source and a phototransistor, an ultrasonic wave sensor or the like. Reference numeral 12 denotes a guide plate for directing the recording material conveyed by the conveyor belt 5 to the nip between the pair of fixing rollers 11.

In the above-described construction, the pair of fixing rollers 11 are designed to be rotatively driven selectively at a first peripheral speed $Vr_1$ and a second peripheral speed $Vr_2$ higher than the first peripheral speed $Vr_1$. The first peripheral speed $Vr_1$ is set so that $Vr_1 < Vb$, where Vb is the conveyance speed of the conveyor belt 5. In the present embodiment, the pair of fixing rollers 11 when in their steady state are adapted to be driven at the second peripheral speed $Vr_2$.

Figure 2:
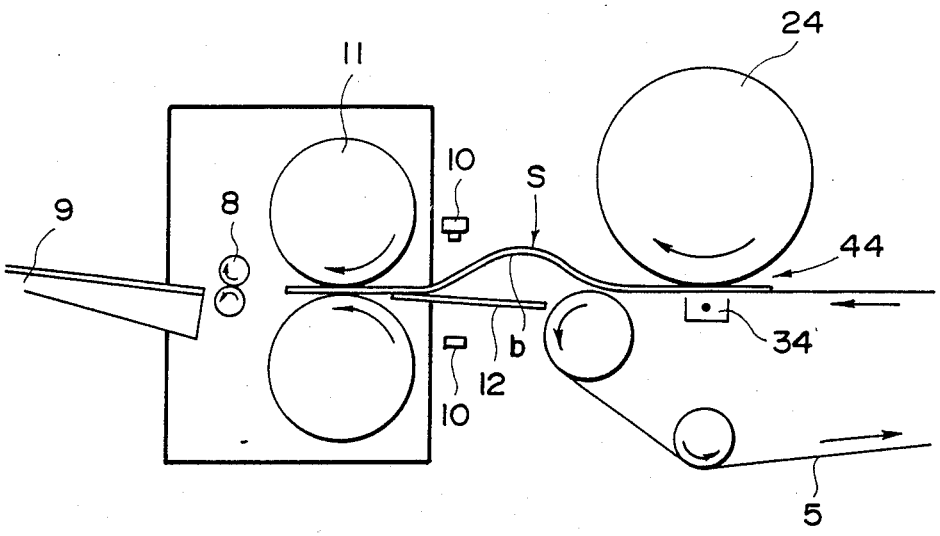
FIG. 2 is a schematic view showing the essential portions of an embodiment of the image forming apparatus according to the present invention.

The speed change-over of the pair of fixing rollers will now be described with reference to FIG. 2.

The recording material S conveyed by the conveyor belt 5 has its leading edge detected by the sensor 10. By the detection signal, the peripheral speed of the pair of fixing rollers 11 is changed over and controlled to $Vr_1$ at a point of time whereat at least the leading edge of the recording material S arrives at the nip between the pair of fixing rollers 11.

On the other hand, in the apparatus of the present embodiment, the distance along the recording material conveyance path between the nip between the pair of fixing rollers 11 and the transfer station 44 is shorter than the length of the recording material S used (with respect to the direction of conveyance) and therefore, the trailing end portion of the recording material S is being subjected at least to the image transfer at the transfer station 44 when the leading end portion of the recording material S is nipped between the pair of fixing rollers 11. Since the peripheral speed of the pair of fixing rollers 11 is controlled to $Vr_1$, the recording material S present between the nip between the pair of fixing rollers 11 and the transfer station 44 forms a loop b rearwardly of the pair of fixing rollers, as shown in FIG. 2. The image being transferred is prevented from being disturbed by the formation of such loop even if the speed of the pair of fixing rollers varies more or less, and therefore the drive control of the fixing rollers can be accomplished roughly. However, if at this time, the loop b grows too large, the unfixed images will come into contact with a portion of the interior of the apparatus body, and the increased curvature of the recording material S will disturb the unfixed images, thus preventing an accurate copy image from being obtained. So, it is necessary that after the time during which a predetermined amount of deformation of the loop b is obtained has elapsed, the pair of fixing rollers 11 be driven at a peripheral speed higher than the first peripheral speed $Vr_1$ to thereby prevent the loop of the recording material from increasing beyond a predetermined amount. For this purpose, after the lapse of a predetermined time t, the peripheral speed of the pair of fixing rollers 11 is restored to the aforementioned second peripheral speed $Vr_2$ and the loop b of the recording material S shown in FIG. 2 is controlled to a predetermined amount of deformation. By the value of the second peripheral speed $Vr_2$ being varied, the amount of deformation of the loop b can be controlled so as not to exceed a predetermined amount even when it exhibits a maximum value, or the amount of deformation of the loop b can be decreased below the predetermined amount.

The value of the peripheral speed $Vr_2$ may preferably be $Vr_2 \geqq Vb$ in order that the size of the loop of the recording material may be suppressed early.

Figure 3:
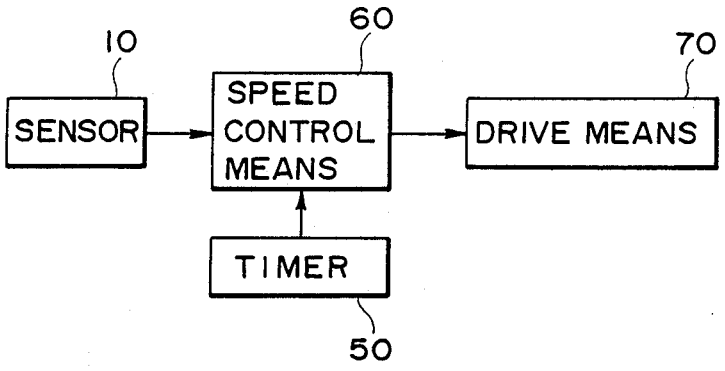
FIG. 3 is a block diagram showing the control system in the embodiment of FIG. 2.

The control system of the present embodiment will now be described with reference to FIG. 3. When the sensor 10 detects the leading edge of the recording material S, the detection signal is received by speed control means 60, whereby drive means 70 connected to the pair of fixing rollers 11 is controlled and the peripheral speed of the pair of fixing rollers 11 is changed over from the second peripheral speed $Vr_2$ to the first peripheral speed $Vr_1$. Further, after the lapse of a predetermined time, a signal is delivered to the speed control means 60 by a timer 50 so that the peripheral speed of the pair of fixing rollers 11 restores the second peripheral speed $Vr_2$.

Figure 4:
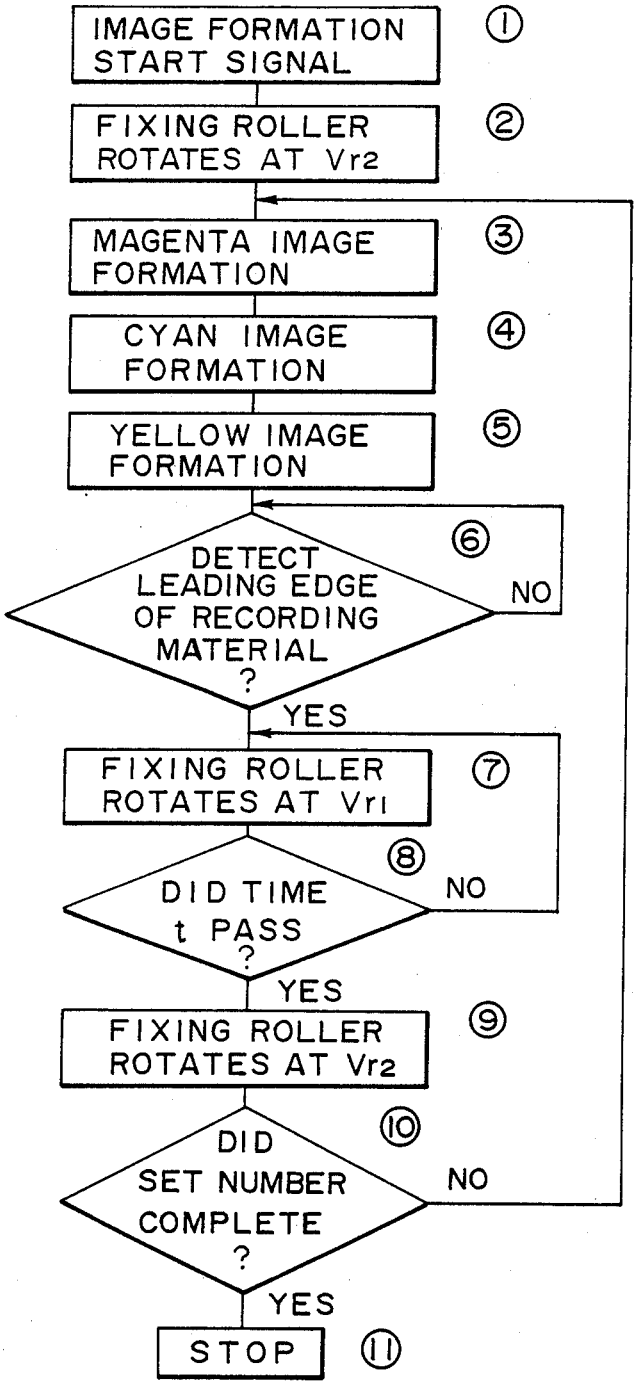
FIG. 4 is a flow chart of the speed control in the embodiment of FIG. 2.
Figure 5:
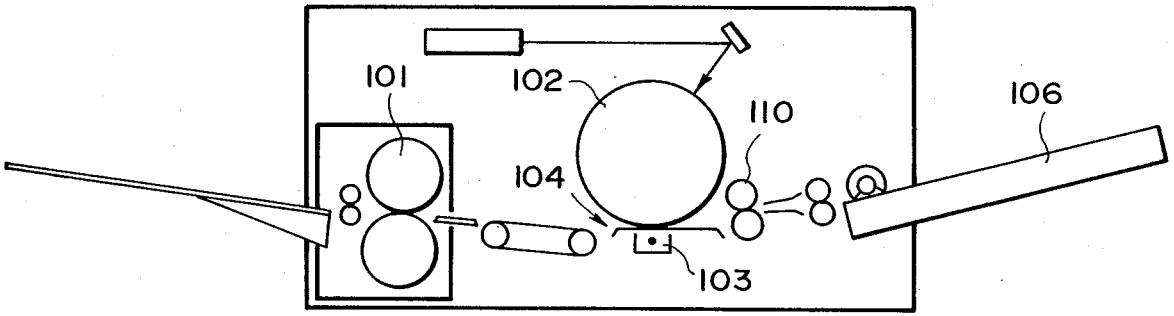
FIG. 5 PRIOR ART
FIGS. 5 and 6 are schematic views showing image forming apparatuses according to the prior art.
Figure 6:
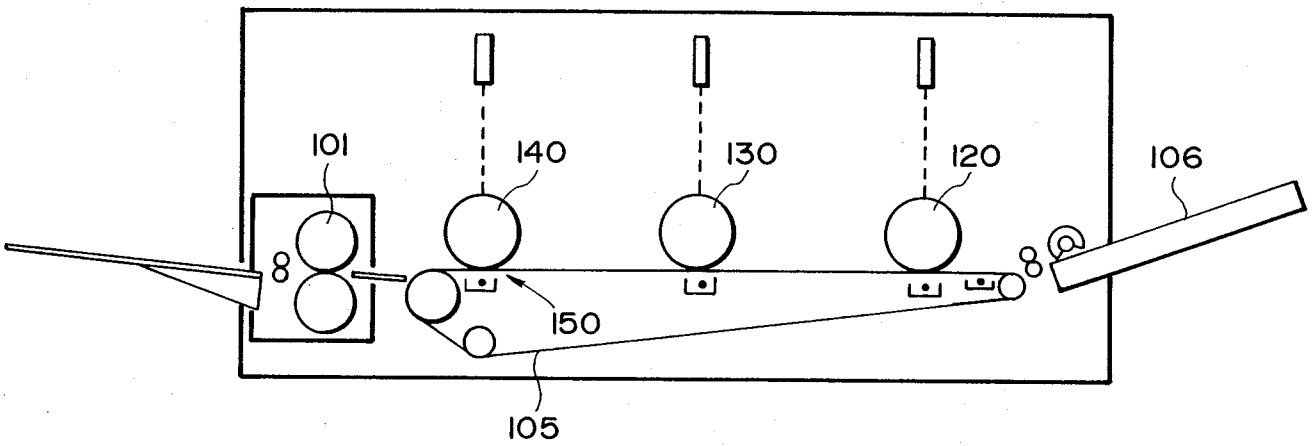
FIG. 6 PRIOR ART

The operation in the process of the formation of the loop b of the recording material S as described above will now be explained with reference to the flow chart of FIG. 4. When an image formation start signal is first sent out at step①, the pair of fixing rollers 11 are rotated at the second peripheral speed $Vr_2$ (step 2), and then by steps③, ④ and ⑤, the recording material passes through the transfer stations 42, 43 and 44 comprising the photosensitive drums 22, 23 and 24 and the chargers 32, 33 and 34, whereby the unfixed images of respective colors are transferred onto the recording material in the order of magenta, cyan and yellow, and when at step⑥, the sensor 10 detects the leading edge of the recording material S, the peripheral speed of the pair of fixing rollers 11 changes over to the first peripheral speed $Vr_1$ (step⑦). If at this time, the sensor 10 does not detect the leading edge of the recording material S, it re-detects the leading edge. Further, at step⑧, whether the predetermined time t has passed is judged, and if the predetermined time t has passed, the peripheral speed of the pair of fixing rollers restores the second peripheral speed $Vr_2$. If in this case, the predetermined time t has not passed, the program returns to step⑦. When the formation of images on a set number of recording materials is completed at step ⑩, the apparatus is stopped from operating at step ⑪. On the other hand, if the formation of images on the set number of recording materials is not completed at step ⑩, the program returns to step③, whereby an operation similar to what has been previously described is performed.

In the above-described embodiment, the peripheral speed of the pair of fixing rollers 11 in their steady state has been the second peripheral speed $Vr_2$, but alternatively, the control may be such that the peripheral speed of the pair of fixing rollers in their state is the first peripheral speed $Vr_1$ and in a predetermined time after the recording material S has entered the nip between the pair of fixing rollers 11, the peripheral speed of the pair of fixing rollers 11 is changed over to the second peripheral speed $Vr_2$, and in a further predetermined time thereafter, the peripheral speed of the pair of fixing rollers 11 restored to the first peripheral speed $Vr_1$.

Also, where the peripheral speed of the pair of fixing rollers 11 in their steady state is $Vr_2$ as in the above-described embodiment, the point of time at which the peripheral speed is changed to $Vr_1$ has been the point of time at which the leading edge of the recording material is detected, in the above-described embodiment, whereas this is not restrictive, but for example, the peripheral speed may be changed from $Vr_2$ to $Vr_1$ in a predetermined time after the recording material has been fed from the cassette.

Figure 7:
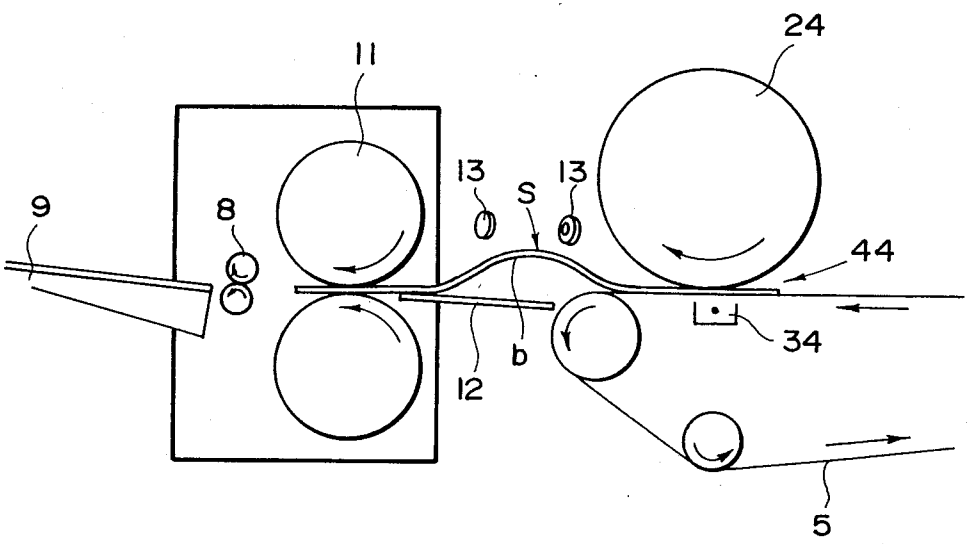
FIG. 7 is a schematic view showing the essential portions of an image forming apparatus provided with detector means for detecting the size of the loop of a recording material.

FIG. 7 shows another embodiment of the present invention. In FIG. 7, reference numeral 13 designates a sensor for detecting the magnitude of the amount of deformation of the formed loop of the recording material. The sensor 13 is disposed between the photosensitive drum 24 and the pair of fixing rollers 11, and comprises, for example, a light source and a phototransistor, an ultrasonic wave sensor or the like.

Figure 8A:
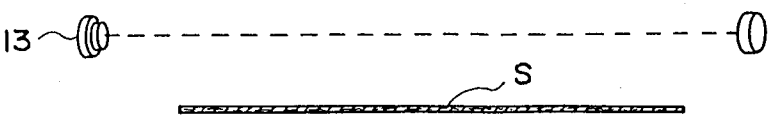
FIGS. 8A and 8B schematically show the state of the recording material in the image forming apparatus of FIG. 7 before it enters the nip between a pair of fixing rollers, FIG. 8A being a cross-sectional view of the recording material as seen from the direction of conveyance thereof, and FIG. 8B being a side view of the recording material as seen from a direction perpendicular to the direction of conveyance thereof.
Figure 8B:
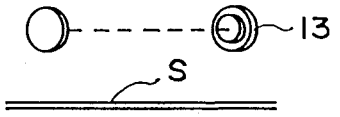
Figure 9A:
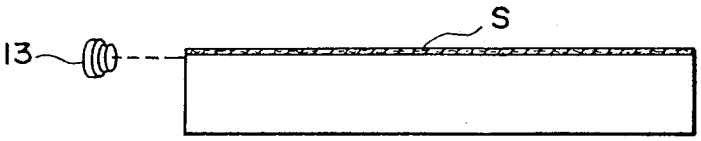
FIGS. 9A and 9B are a schematic cross-sectional view and a side view, respectively, showing the state in which the loop of the recording material is formed in the image forming apparatus of FIG. 7 after the recording material has entered the nip between the pair of fixing rollers.
Figure 9B:
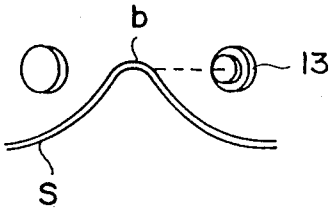

Description will now be made of a method of detecting the size of the loop of the recording material by the use of the sensor 13 and controlling the speed of the pair of fixing rollers. FIGS. 8A and 8B show the state of the recording material S before it enters the nip between the pair of fixing rollers 11. (FIG. 8A is a view of the recording material as seen from the direction of conveyance thereof, and FIG. 8B is a view of the recording material as seen from a direction perpendicular to the direction of conveyance thereof). The peripheral speed of the pair of fixing rollers 11 at this time is $Vr_1$ in the present embodiment. When the recording material S thereafter enters the nip between the pair of fixing rollers 11, a loop b is formed in the recording material S due to the difference between the speed Vb of the conveyor belt 5 and the peripheral speed $Vr_1$ of the pair of fixing rollers 11. As the fixation progresses, the size of the loop b increases and reaches the state shown in FIGS. 9A and 9B, whereupon the sensor 13 detects the loop b. In correspondence to the detection signal of the sensor 13, the peripheral speed of the pair of fixing rollers 11 is changed over from $Vr_1$ to $Vr_2$ higher than $Vr_1$. By the peripheral speed of the pair of fixing rollers 11 being thus changed over, the difference between the peripheral speed $Vr_2$ of the pair of fixing rollers 11 and the speed Vb of the conveyor belt becomes smaller than the difference between the peripheral speed $Vr_1$ of the pair of fixing rollers 11 and the speed Vb of the conveyor belt and therefore, the size of the formed loop b decreases. When the size of the loop b decreases and the sensor 13 no longer detects the loop b, the peripheral speed of the pair of fixing rollers 11 restores $Vr_1$ in correspondence thereto and thus, the size of the loop b increases again. In this manner, in the present embodiment, the actually formed loop of the recording material is detected to control the peripheral speed of the pair of fixing rollers 11 so as to maintain the amount of formed loop of the recording material at a predetermined amount. Again in the present embodiment, as in the previous embodiment, it is preferable in decreasing the size of the loop of the recording material early that a value which satisfies the relation that $Vr_2 \geqq Vb$ be used as the peripheral speed $Vr_2$.

Figure 10:
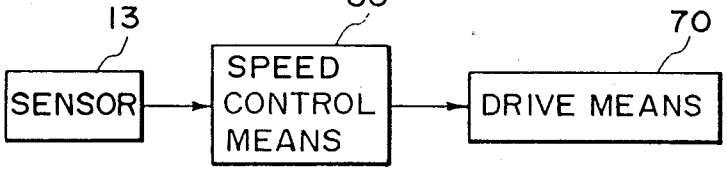
FIG. 10 is a block diagram showing the control system in the embodiment of FIG. 7.

The control system of the present embodiment will now be described with reference to FIG. 10. When the sensor 13 detects the loop b, the detection signal thereof is received by speed control means 60, whereby drive means 70 connected to the pair of fixing rollers 11 is controlled to change the peripheral speed of the pair of fixing rollers 11 to Vr2.

On the other hand, when the size of the loop b decreases and the sensor 13 no longer detects the loop b, the drive means 70 is again controlled by the speed control means 60 to change the peripheral speed of the pair of fixing rollers 11 to Vr1 which is lower than the speed Vb of the conveyor belt 5. That is, the peripheral speed of the pair of fixing rollers at this time is made equal to the peripheral speed of the pair of fixing rollers before the recording material enters the nip between the pair of fixing rollers 11.

Figure 11A:
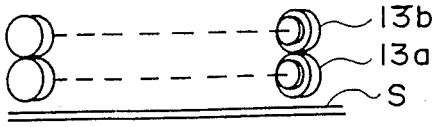
FIGS. 11A, 11B and 11C are schematic side views showing another example of the detector means for detecting the size of the loop of the recording material.
Figure 11B:
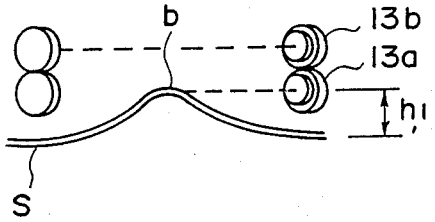
Figure 11C:
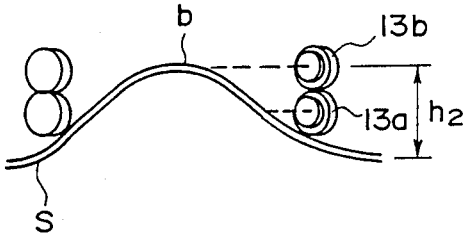
Figure 12:
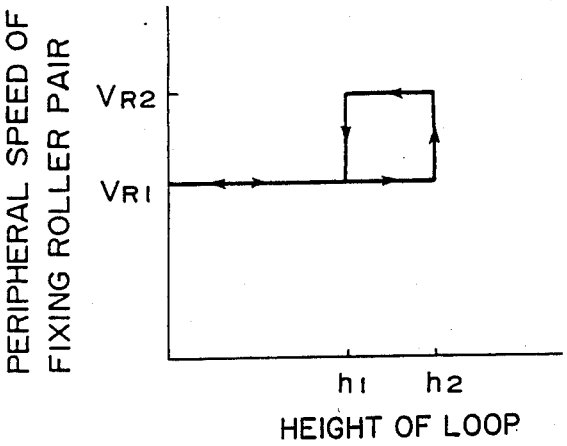
FIG. 12 is a graph showing the relation between the peripheral speed of the pair of fixing rollers and the height of the loop of the recording material.

FIGS. 11A, 11B and 11C show another example of the detecting means for detecting the loop of the recording material. In FIG. 11A, the recording material S is shown in its state before it enters the nip between the pair of fixing rollers 11, and the then peripheral speed of the pair of fixing rollers 11 is Vr1 which is lower than the speed Vb of the conveyor belt 5. When from this state, the recording material S enters the nip between the pair of fixing rollers 11, a loop is formed in the recording material S as shown in FIG. 11B. In this state of the recording material, the sensor **13*a* detects the bend b of the loop, but the peripheral speed of the pair of fixing rollers 11 remains to be Vr1. As the fixation further progresses, the size of the bend b increases as shown in FIG. 11C. When the peripheral speed of the pair of fixing rollers 11 is changed to Vr2 at this time as the sensor 13*b* detects the bend b, the size of the bend b decreases again as shown in FIG. 11B. In this state, the bend b is detected by only the sensor 13*a*, but if the peripheral speed of the pair of fixing rollers 11 is restored to Vr1 at a point of time whereat the sensor 13*a* no longer detects the bend b, the size of the bend b increases again as shown in FIG. 11C. By such speed change-over, the size of the loop of the recording material is maintained at a predetermined size with the height of the bend held between $h_1$ and $h_2$ as shown in FIG. 12**.

Now, in the present embodiment, the peripheral speed of the pair of fixing rollers in their steady state has been Vr1, but alternatively, said peripheral speed may be Vr2 and further detecting means for detecting the leading edge of the recording material as in the previously described embodiment may be provided discretely and in accordance with the detection signal produced upon detection of the leading edge of the recording material, the peripheral speed of the pair of fixing rollers may be changed over from Vr2 to Vr1. Again in this case, after the recording material is nipped between the pair of fixing rollers, the peripheral speed of the pair of fixing rollers may be controlled in conformity with the detection signal of the sensor 13 or the sensors **13*a* and 13*b***.

As described above, according to the present invention, the peripheral speed of the pair of fixing rollers is suitably changed over and controlled, whereby the recording material still present at the position whereat the unfixed image is formed on the recording material (for example, the transfer position) is prevented from being pulled by the pair of fixing rollers and therefore, in a full color image forming apparatus, color misregistration of images is eliminated, and in a monochromatic image forming apparatus, stretch of image is eliminated and thus, an accurate and clear-cut image output can be obtained.

Also, the loop of the recording material formed rearwardly of the pair of fixing rollers is maintained at a predetermined size, whereby the behavior of the recording material changed little and the image on the recording material is not disturbed. In addition, the loop of the recording material can be prevented from becoming too large and therefore, spring-back occurs due to the resiliency of the loop-like recording material itself whereby even the problem that the trailing end portion of the recording material recedes to cause image misregistration can be solved.

Further, according to the present invention, the pair of fixing rollers need not be rotated from their stopped condition each time the leading edge of the recording material arrives at the nip between the pair of fixing rollers and therefore, a drive interrupting mechanism such as a clutch need not be frequently used and accordingly, the problem of mechanical rising and falling is eliminated and accurate inter-sheet spacing during continuous feeding of recording sheets is secured. Also, the shock with which the recording material enters the nip between the pair of fixing rollers is small and therefore, the image on the recording material is not disturbed.

Also, the distance between the position at which an unfixed image is formed on the recording material and the nip between the pair of fixing rollers may be shorter than the length of the recording material used and may be enough to permit the loop of the recording material to be formed, and this leads to the possibility of making the apparatus compact.

The above embodiments of the present invention have been described with respect to the electrophotographic type in which a photosensitive member is used as an image bearing member and is subjected to charging and exposure to form a latent image, but adoption may also be made of the electrostatic recording type in which a dielectric member is used as an image bearing member and a latent image corresponding to image information is directly formed thereon.

Also, in the previously described embodiments of the present invention, the formation of unfixed images on the recording material has been shown with respect to a case where the developed images formed on the image bearing members are transferred to the recording material, whereas this is not restrictive, but the present invention also covers a case where unfixed images are formed directly on the recording material.

Further, in the present invention, where a heating-fixing roller device is employed as fixing means, when the peripheral speed of the pair of fixing rollers is made high, the amount of heat imparted to the recording material at the nip portion per unit time becomes smaller than when the peripheral speed of the pair of fixing rollers is low. Therefore, where a problem arises in respect of fixative property, the set temperature of heating means for heating the fixing rollers may be increased or auxiliary heating means may be operated as the peripheral speed of the pair of fixing rollers is accelerated, whereby the amount of heat imparted to the recording material at the nip portion may be compensated for.

What is claimed is:

1. An image forming apparatus comprising:

image forming means for forming an unfixed toner image on recording material;

fixing means having a pair of rotatable members for conveying the recording material therebetween and fixing said unfixed toner image on the recording material, a distance along a conveyance path of the recording material between a position at which the unfixed toner image is formed on the recording material by said image forming means and a nip position of said pair of rotatable members being shorter than the length of the recording material used with respect to a direction of conveyance of the recording material;

conveying means for conveying the recording material having said unfixed toner image formed thereon to said fixing means;

drive means for rotatably driving said pair of rotatable members selectively at a first peripheral speed lower than a speed at which said conveying means conveys the recording material and a second peripheral speed higher than the speed at which said conveying means conveys the recording material; and control means for controlling said drive means, said control means controlling said drive means so as to rotate said pair of rotatable members at said first peripheral speed to thereby convey the recording material and to form a loop of the recording material having said unfixed toner image formed thereon between the nip position of said pair of rotatable members and the position at which the unfixed toner image is formed on the recording material by said image forming means, and thereafter to change said first peripheral speed to said second peripheral speed, thereby suppressing growth of the loop of said recording material greater than a predetermined amount.

2. An image forming apparatus according to claim 1, further comprising detector means for detecting a leading edge of the conveyed recording material at the upstream side of said pair of rotatable members with respect to the direction of conveyance of the recording material and wherein the peripheral speed of said pair of rotatable members is set to said first peripheral speed in accordance with a detection signal produced when said detector means detects the leading edge of said recording material.

3. An image forming apparatus according to claim 2, wherein in a predetermined time after the peripheral speed of said pair of rotatable members is set to said first peripheral speed, the peripheral speed of said pair of rotatable members is changed over from said first peripheral speed to said second peripheral speed, said predetermined time corresponding to the time from setting the peripheral speed of said pair of rotatable members to said first peripheral speed until a loop of the recording material of a predetermined size is formed.

4. An image forming apparatus according to claim 3, wherein before said detector means detects the leading edge of the recording material, said pair of rotatable members are rotatively driven at said second peripheral speed.

5. An image forming apparatus according to claim 1, further comprising detector means for detecting the size of the loop of said recording material and wherein the peripheral speed of said pair of rotatable members is set to said second peripheral speed in accordance with a detection signal produced when said detector means detects that the loop of said recording material has assumed a predetermined size.

6. An image forming apparatus according to claim 5, wherein said detector means has first and second detecting portions for detecting the loop of the recording material at two different height positions in order to maintain the size of the loop of the recording material at a predetermined size.

7. An image forming apparatus according to claim 1, wherein said fixing means is heating-fixing means.

8. An image forming apparatus according to claim 7, wherein the amount of heat imparted to the recording material at the nip position between said pair of rotatable members when said second peripheral speed is selected as the peripheral speed of said pair of rotatable members is greater than when said first peripheral speed is selected.

9. An image forming apparatus according to claim 1, wherein said image forming means has an image bearing member, means for forming a latent image on said image bearing member, means for developing the formed latent image into a developed image and means for transferring the developed image on said image bearing member onto said recording material.

10. An image forming apparatus according to claim 9, wherein the unfixed toner image is generated on the recording material at the image transfer position.

11. An image forming apparatus according to claim 9, wherein a plurality of said image forming means are disposed along the conveyance path of the recording material, and developed images of different colors are transferred onto the recording material from the image bearing members of the respective image forming means.

12. An image forming apparatus according to claim 11, wherein the loop of said recording material is formed between the nip position between said pair of rotatable members and a transfer position of one of said plurality of image forming means which is most downstream with respect to the direction of conveyance of the recording material.

13. An image forming apparatus according to claim 11, wherein said conveying means is in the form of belt-like conveying means, and said belt-like conveying means supports the recording material thereon, passes the recording material to transfer stations of said plurality of image forming means, and thereafter conveys the recording material to said fixing means.

* * * * *